United States Patent [19]

Shenoy

[11] 4,454,559

[45] Jun. 12, 1984

[54] CONTROL FOR A CORONA DISCHARGE DEVICE

[75] Inventor: Vittal U. Shenoy, Fairport, N.Y.

[73] Assignee: Xerox Corporation, Stamford, Conn.

[21] Appl. No.: 412,683

[22] Filed: Aug. 30, 1982

[51] Int. Cl.[3] ..... G03G 15/00

[52] U.S. Cl. ..... 361/214; 361/229; 361/235; 355/3 CH

[58] Field of Search ..... 361/214, 225, 229, 235; 355/3 CH, 14 CH

[56] References Cited

U.S. PATENT DOCUMENTS

| | | | |
|---|---|---|---|
| 3,586,908 | 6/1971 | Vosteen | 361/229 |
| 3,667,036 | 5/1972 | Seachman | 324/72 |
| 3,678,350 | 7/1972 | Matsumoto et al. | 361/229 |
| 3,835,380 | 9/1974 | Webb | 324/72 |
| 3,887,845 | 6/1975 | Michatek | 361/225 |
| 3,950,680 | 4/1976 | Michaels et al. | 361/229 |
| 4,265,990 | 5/1981 | Stolka et al. | 430/59 |
| 4,286,862 | 9/1981 | Akita et al. | 361/235 X |
| 4,318,610 | 3/1982 | Grace | 355/14 |

FOREIGN PATENT DOCUMENTS

| | | | |
|---|---|---|---|
| 56-156848 | 3/1981 | Japan | 361/214 |

*Primary Examiner*—E. A. Goldberg
*Assistant Examiner*—Derek Jennings

[57] ABSTRACT

Control apparatus for a corona discharge device to be utilized in a xerographic reproduction machine. The control is characterized by utilizing the shield or coronode voltage to derive signals which can be used for maintaining the photoconductive surface of the machine at a predetermined voltage level. The voltage level on the shield or coronode is measured twice, once with the surface in its conducting state and with the surface in its non-conducting state. The difference between the two voltages is compared to a reference voltage to generate an output signal for controlling the voltage applied to either the shield or coronode depending upon which is being used.

6 Claims, 5 Drawing Figures

CONTROL FOR A CORONA DISCHARGE DEVICE

BACKGROUND OF THE INVENTION

This invention relates to a corona discharge device for use in xerographic reproduction machines and, more particularly, to an improved control therefor which utilizes the voltage on either the coronode or the conductive shield of the corona discharge device for controlling the charge level on the photoconductive surface.

In xerographic reproduction copying machine, a predetermined uniform charge is normally placed on the surface of a photoconductor in preparation for imaging. The charged photoconductor or photoconductive surface is then exposed to a light image in order to form a latent electrostatic image. The latent image is then rendered visible by applying an electrostatically attractable marking medium conventionally referred to as toner with subsequent transfer of the toner image to a copy sheet. Following transfer, the image bearing sheet is subjected to a combination of heat and pressure or solely pressure to permanently fix or fuse the image to the copy sheet.

The charge level on the photoconductor of the machine is critical to the production of good quality copies. Thus, it is desirable to check, either intermittently or continuously, the charge level on the photoconductive surface for the purpose of making adjustments to the power supply for the corona discharge device. One device which may be used to measure the charge on the photoconductive surface comprises an electrometer. Since it is generally considered desirable to avoid placing an element in physical contact with the moving photoconductor except where absolutely necessary for fear of damaging or scratching the fragile surface of the photoconductor, electrometers employ a rather sophisticated and expensive capacitance type probe which permits probe placement adjacent to but out of physical contact with the photoconductive surface. Electrometer probes can also be positioned under the corona generator to measure the output thereof. Examples of such systems include those disclosed in U.S. Pat. No. 3,835,380 issued Sept. 10, 1974 to T. J. Webb and the reference listed therein; and U.S. Pat. Nos. 3,586,908 to R. Vosteen, 3,678,350 to S. Matsumoto et al. and 3,667,036 to N. Seachman. The charge measurement made in this way can be beneficially utilized to control various corona generator outputs or the like. However, these electrometers obviously require the use of electrometers and they occupy valuable space around the imaging surface and can only measure the charge in the position in which they are located. It is not economically or spacially desirable to provide several electrometers for measuring the charge on the imaging surface downstream of most of the corona generators in a copying apparatus. Moving an electrometer between different locations takes time and does not allow simultaneous measurements.

The space and expense problem of multiple electrometer probes is addressed in U.S. Pat. No. 3,950,680 issued in the name of Michaels et al. As stated therein, in that system the portion of each corona generator current going to its conductive shield is subtracted from the total input current supplied to that corona generator to provide a measurement of the current actually going from the corona generator to the imaging surface or plate. This is based on the principle that the total input current supplied to the corona generators must go to either the imaging surface or the shield and that if the shield current is electrically floated slightly above ground it can be fed back and subtracted to achieve the measurement of the true plate (imaging surface) current and therefore, the current applied charged. A current measuring device is utilized in a circuit comprising only the photoreceptor.

Another method of controlling the charge on the photoconductive surface is to develop a test image on the photoconductive surface in the inter-document area and to utilize an infrared densitometer in conjunction with the test image to develop an electrical output which is useful in controlling the charge level of the photoreceptor. Such a method is disclosed in U.S. Pat. No. 4,318,610 issued in the name of Robert E. Grace. As will be appreciated by those skilled in the art a test patch creates or represents a stress condition for the cleaning system of the reproduction apparatus and therefore may not be desirable for some applications.

Still another method of measuring or controlling the charge on a photoconductive surface utilizes a roller probe which is physically in contact with the photoconductive surface. As suggested in U.S. Pat. No. 3,887,845 issued to Robert J. Michatek, the roller probe can be the bias transfer roll in a machine where a bias transfer roll is utilized. Otherwise, the roller probe can be a separate roller. The obvious disadvantage of utilizing a bias transfer roll is in machines that do not utilize a bias transfer roll. Also, the spacial problems associated with electrometers are also inherent in roller probes.

SUMMARY OF THE INVENTION

In accordance with the features of the present invention, there is provided an apparatus for controlling the charge level on a photoconductive surface which utilizes the voltage on either the coronode or the conductive shield in order to control the voltage level on the photoreceptor. To this end, two measurements of either the coronode or shield voltage are actually taken, one with the photoconductive surface in its insulating or non-conducting state and the other with the photoconductive surface in its conductive state. By measuring the difference between the two voltages during the conductive and non-conductive states of the photoconductive surface, the device is substantially insensitive to ambient condition variations as well as variations in the process parameters. This method of using shield or coronode voltage is made possible by the recognition that the shield or coronode voltage needed to establish a given amount of current through a bare plate, (i.e. a photoconductive surface that is made conductive as by flood illumination) is less than that needed to establish the same current through a photoconductive surface that is non-conducting. The difference in voltage is very nearly equal to or is a fixed proportion of the charge level on the photoconductive surface. Thus, this voltage difference can be used to represent the charge on the photoconductive surface and as such it can be used to insure that the surface is charged to a predetermined level.

BRIEF DESCRIPTION OF THE DRAWINGS

Other aspects of the present invention will become apparent as the following description proceeds with reference to the drawings.

DESCRIPTION OF THE PREFERRED EMBODIMENT

Figure 1:
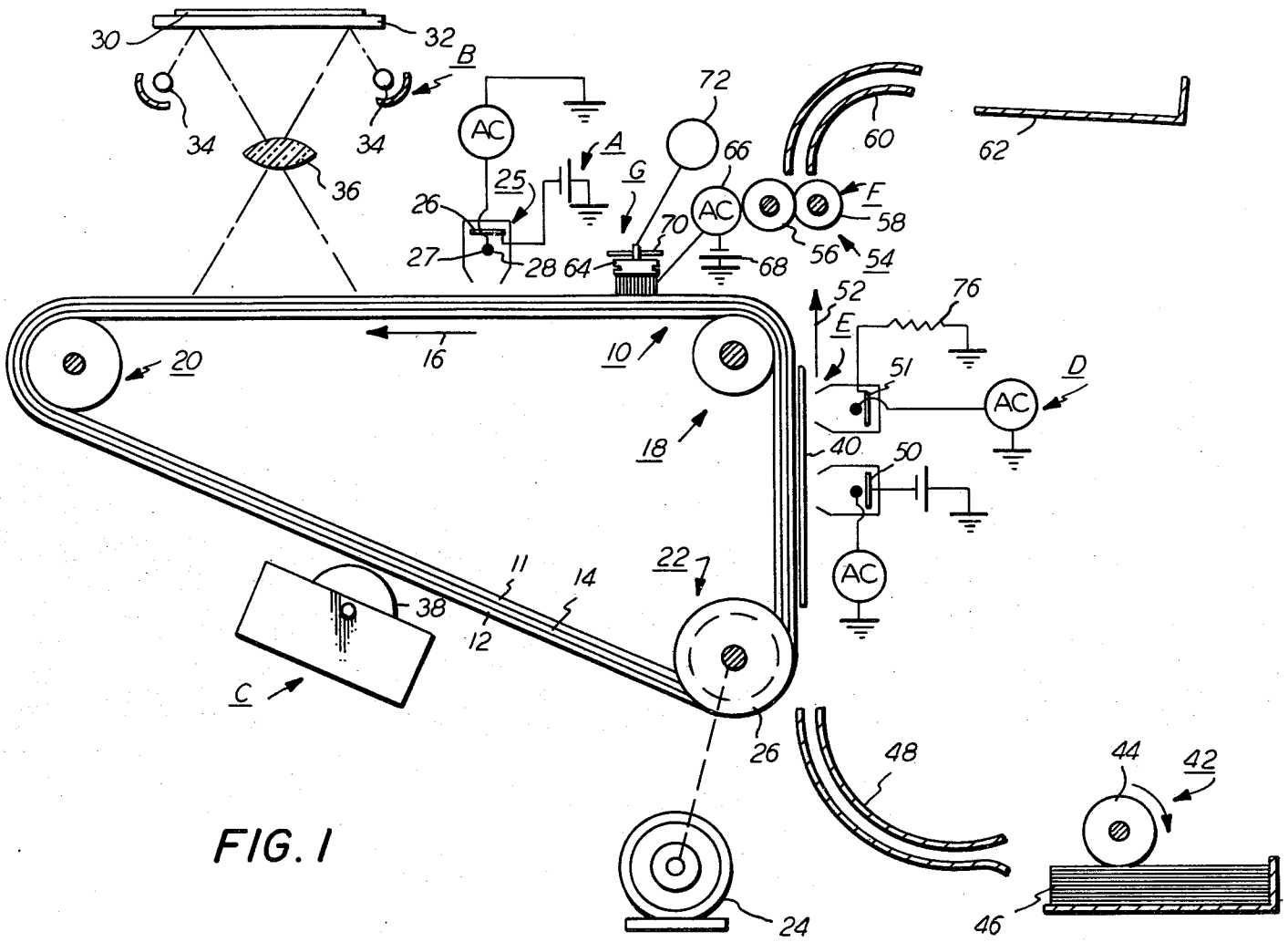
FIG. 1 is a schematic elevational view of an electric photographic printing machine incorporating the features of the present invention therein.

For a general understanding of the features of the present invention, a description thereof will be made with reference to FIG. 1 of the drawings. FIG. 1 schematically depicts the various components of an illustrative electrophotographic printing machine incorporating the apparatus and method of the present invention.

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al., the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by the reference numeral 25, charges the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current when an a.c. voltage is applied to the corona wire and when the shield and photoconductive surface are at the same potential. Stated differently, in the absence of an external field supplied by either a bias applied to the shield or a charge on the photoreceptor there is substantially no net d.c. current flow Next, the charged portion of photoconductive belt is advanced through exposure station B. At exposure station B, an original document 30 is positioned facedown upon transparent platen 32. Lamps 34 flash light rays onto original document 30. The light rays reflected from original document 30 form light images which are transmitted through lens 36. The light images are projected onto the charged portion of the photoconductive belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoconductive belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays negative ions onto the backside of sheet 40 so that the toner powder images which comprise positive toner particles are attracted from photoconductive belt 10 to sheet 40. For this purpose, approximately 50 microamperes of negative current flow to the copy sheet is effected by the application of a suitable corona generating voltage and proper bias.

Subsequent to transfer the image sheet moves past a detack corona generating device 51 positioned at a detact station E. At the detack station the charges placed on the backside of the copy sheet during transfer are partially neutralized. The partial neutralization of the charges on the backside of the copy sheet thereby reduces the bonding forces holding it to the belt 10 thus enabling the sheet to be stripped as the belt moves around the rather sharp bend in the belt provided by the roller 18. After detack, the sheet continues to move in the direction of arrow 52 onto a conveyor (not shown) which advances the sheet to fusing station F.

Fusing station F includes a fuser assembly, indicated generally by the reference numeral 54, which permanently affixes the transferred toner powder images to sheet 40. Preferably, fuser assembly 54 includes a heated fuser roller 56 adapted to be pressure engaged with a backup roller 58. Sheet 40 passes between fuser roller 56 and backup roller 58 with the toner powder image contacting fuser roller 56. In this manner, the toner powder image is permanently affixed to sheet 40. After fusing, chute 60 guides the advancing sheet 40 to catch tray 62 for removal from the printing machine by the operator.

At an image disturbing station G, there is provided an electrically conductive brush 64 to which an a.c. voltage is supplied from a source 66. A d.c. bias 68 is applied to the a.c. source 66. The brush is adapted to be cyclically moved in a direction substantially perpendicular to the direction of movement of the photoconductive belt 10. Such movement may be accomplished by means of a cam structure 70 operatively connected to a motor 72.

In one operative embodiment, the a.c. voltage was 1500 volts at 250 Hz and the d.c. bias voltage as equal to a negative 250 volts while the mechanical frequency of the brush was 1800 cycles per minute. With a brush to belt interference of 0.10 inch it is desirable for optimum results that the relative speed between the belt and brush is such as to permit the brush to make two complete oscillations during the time a point on the photoconductive belt moves through the nip (i.e. area of contact between the brush and belt) formed between the brush and the belt.

During operation of the brush structure, the toner forming the residual images remaining on the photoconductive belt after the transfer step is redistributed such that it can be removed by the magnetic brush developer roller 38 as the redistributed toner moves through the development station C.

The dicorotron structure is the same for all of the corona devices but the voltages and biases and methods of applying them are not necessarily the same. In fact, the detack corona device 51 is operated quite differently from the other corona devices. An a.c. voltage is applied to the dicorotron electrode with the shield connected to ground through an impedance such as a resistor 76. With such an arrangement, when the photoconductive surface with the sheet 40 adhered thereto through electrostatic bonds resulting from the transfer operation, moves through the detack station, the voltage contained on the backside of the sheet 40 establishes an electrostatic field between the shield and the copy sheet. This field causes current to flow between the dicorotron electrode and the backside of the copy sheet and between the dicorotron electrode and the shield. Thus, a current flows through the resistor 76 which developes a voltage across it which is the desired shield bias voltage. A suitable value for the resistance of resistor 76 is 5–50 megohm depending on process speed. This resistance range results in positive current flow to the copy sheet on the order of 5–20 microamperes depending on such factors as paper weight and resistivity.

The corona wire 27 may be supported in conventional fashion at the ends thereof by insulating end blocks (not shown) mounted within the ends of shield structure 26. The wire may be made of any conventional conductive filament material such as stainless steel, gold aluminum, copper, tungsten, platinum or the like. The diameter of the wire 11 is not critical and may vary typically between 0.5–15 mil and preferably is about 3–6 mils.

Any suitable dielectric material may be employed as the coating 28 which will not break down under the applied corona a.c. voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating used in the corona device of the invention is such that when an a.c. voltage is applied to the wire and with the photoconductive surface and the shield at the same potential substantially no conduction current or d.c. charging current is permitted therethrough. Typically, the thickness is such that the combined wire and dielectric thickness falls in the range from 5–30 mil with a typical dielectric thickness of 1–10 mil. Glasses with dielectric breakdown strengths above 5 KV/mm have been found by experiment to perform satisfactorily as the dielectric coating material. The glass coating selected should be free of voids and inclusions and make good contact with or wet the wire on which it is deposited. Other possible coatings are ceramic materials such as alumina, zirconia, boron nitride, beryllium oxide and silicon nitride. Organic dielectrics which are sufficiently stable in corona may also be used.

Figure 2:
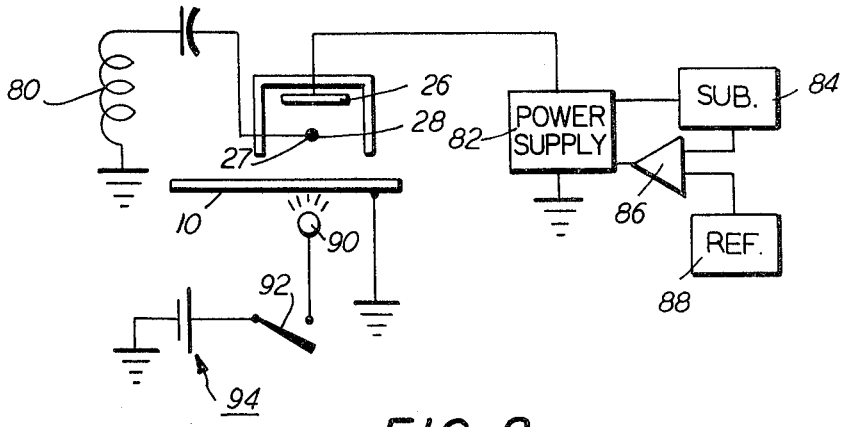
FIG. 2 is a schematic representation of a dicorotron utilizing the control arrangement of the present invention.

As illustrated in FIG. 2, the dicorotron electrode comprising the wire 27 and insulating layer 28 is capacitively coupled to the secondary winding 80 of an a.c. power supply. The conductive shield 26 is operatively coupled to a constant photoreceptor current power supply 82. The voltage applied to the conductive shield 26 by the constant current power supply 82 is fed to a substractor device 84 which may include a conventional sample and hold component and an amplifier the former of which serves to sample and hold a voltage value, representing the voltage on the shield when the photoconductor 10 is non-conducting and then generate a signal representing the difference between that voltage and the voltage on the shield when the photoconductive surface is conducting. The difference between these two voltages is amplified and fed to a comparator 86. Means 88 are provided for providing a reference voltage to the comparator 86 for comparison with the output of the subtractor 84. The output of the comparator is fed to the constant current power supply 82 for modifying the voltage applied to the conductive shield 26. In order to render the photoconductor 10 conductive for the purpose of generating one of the values fed to the subtractor 84, an illumination source 90 is provided which is coupled via switch 92 to a power source 94. Thus, the voltage on the conductive shield 26 with the photoconductor 10 in the conductive and non-conductive states can be fed to the subtractor 84.

The shield voltage needed to establish a given amount of current to a bare plate, (i.e. a photoconductive surface that is made conducting as by flood illumination) is less than that needed to establish the same current through a photoconductive surface that is not conducting. The difference in voltage is very nearly equal to or is a fixed proportion of the charge level on the photoconductive surface. Thus, this voltage difference can be used to represent the change on the photoconductive surface and as such it can be used to insure that the surface is charged to a predetermined level.

Figure 3:
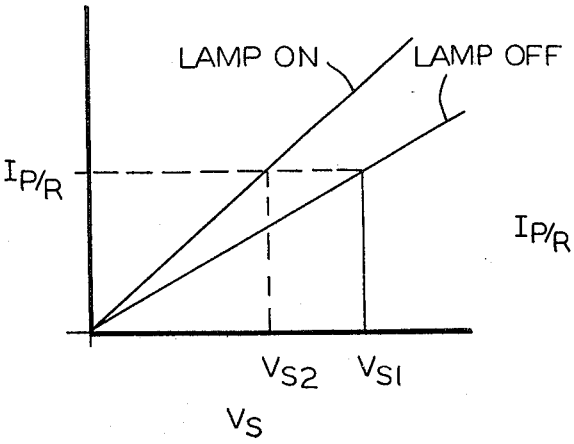
FIG. 3 is a plot of photoreceptor current versus shield voltage for the conducting and non-conducting states of the photoconductive surface for the embodiment of FIG. 2.

In accordance with the foregoing, during operation of the xerographic apparatus, the illumination source 90 is intermittently energized in order to generate a shield voltage $V_{S2}$ as illustrated in FIG. 3 which is fed to the substractor 84 along with the shield voltage $V_{S1}$ the latter of which represents the lamp off or non-conducting state of the photoconductor 10 and the former of which represents the lamp on or conducting state of the photoconductor 10. By utilizing the difference between the $V_{S1}$ and $V_{S2}$ the voltage level on the photoreceptor can be maintained at a constant level by comparing this difference to the reference voltage.

Figure 5:
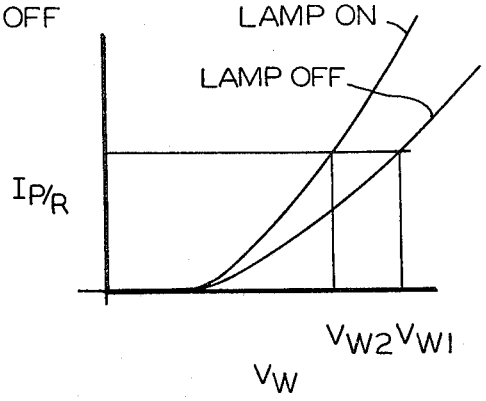
FIG. 5 is a plot of photoconductive surface current versus coronode wire voltage for the conducting and non-conducting states of the photoconductive surface of the embodiment of FIG. 4.
Figure 4:
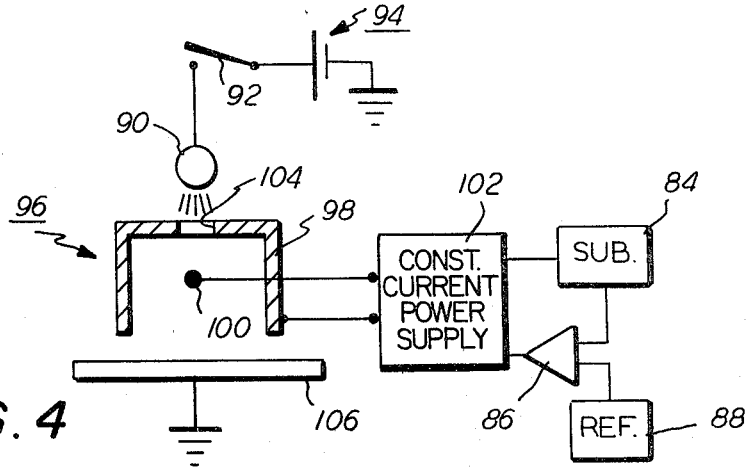
FIG. 4 is a schematic representation of a conventional corotron device utilizing the control scheme of the present invention.

As illustrated in FIGS. 4 and 5, the corona device 25 need not be in the form of a dicorotron but can comprise a conventional corona device 96 which includes a conductive shield 98 and a bare wire 100. The bare wire and shield are connected to a constant photoreceptor current power supply 102 as illustrated in FIG. 4. The lamp 90 is, as in the embodiment disclosed in FIG. 2, utilized to render the photoconductor 10 conductive. For this purpose, the shield 98 is provided with an aperture 104. The photoconductor in this case could be the same or different from that disclosed in conjunction with the embodiment disclosed in FIG. 2. Thus, a photoconductor 106 may comprise a conventional selenium photoconductor. Circuit elements such as the subtracter 84, comparator 86 and reference voltage source 88 are the same as that disclosed in conjunction with FIG. 2. The plot of photoreceptor current versus wire voltage with the photoconductor in the conductive and non-conductive states is plotted in FIG. 5.

I claim:

1. A corona device for depositing a uniform charge on a photoconductive surface comprising:

a coronode member;

a conductive shield member;

means including a constant photoreceptor current power supply for supplying power to one of said members;

means for intermittently illuminating said photoconductive surface;

means for generating an electrical signal representing the difference in the voltage on said one of said members for an illuminated photoconductor condition and a non-illuminated condition; and means for comparing said difference to a reference voltage to derive an output for modify the voltage applied to said one of said members.

2. Apparatus according to claim 1 wherein said power is supplied to said coronode member.

3. Apparatus according to claim 1 wherein said power is supplied to said conductive shield member.

4. The method of uniformly charging a photoconductive surface by means of a corona charging device including a coronode member and a conductive shield member, the method comprising the steps of:

operatively coupling one of said members to a power source;

measuring the voltage on one of said members with said surface in a non-conducting state;

measuring the voltage on said one of said members with said photoconductive surface in a conducting state;

comparing the difference between the two voltages to a reference voltage;

generating a signal representative of the difference between said reference voltage and the voltage difference between said two voltages; and modifying the input of the power supply to said one said members in accordance with said signal.

5. The method according to claim 4 wherein the voltage on said coronode member is measured.

6. The method according to claim 4 wherein the voltage on said conductive shield member is measured.

* * * * *